US011754939B2

(12) United States Patent
Kojima

(10) Patent No.: US 11,754,939 B2
(45) Date of Patent: Sep. 12, 2023

(54) OPTICAL PRINT HEAD AND IMAGE FORMING APPARATUS

(71) Applicant: CANON KABUSHIKI KAISHA, Tokyo (JP)

(72) Inventor: Nobuhisa Kojima, Chiba (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 17/738,377

(22) Filed: May 6, 2022

(65) Prior Publication Data

US 2022/0397839 A1 Dec. 15, 2022

(30) Foreign Application Priority Data

Jun. 15, 2021 (JP) ..... 2021-099302

(51) Int. Cl.
*G03G 15/04* (2006.01)

(52) U.S. Cl.
CPC . *G03G 15/04036* (2013.01); *G03G 15/04054* (2013.01)

(58) Field of Classification Search
CPC ..... G03G 15/04036; G03G 15/04054
See application file for complete search history.

(56) References Cited

U.S. PATENT DOCUMENTS

2012/0075403 A1* 3/2012 Nagamine ..... B41J 2/45 347/262
2016/0085208 A1* 3/2016 Imai ..... G03G 21/20 347/118
2018/0004117 A1* 1/2018 Kasuya ..... G03G 21/1619
2018/0004119 A1* 1/2018 Kasuya ..... G03G 15/04054
2018/0095405 A1* 4/2018 Iwai ..... G03G 21/1633
2018/0364608 A1* 12/2018 Momoka ..... G03G 15/0225
2022/0050399 A1* 2/2022 Momoka ..... G03G 15/04054

FOREIGN PATENT DOCUMENTS

JP 2012-66499 A 4/2012
JP 2017-74943 A 5/2021

* cited by examiner

*Primary Examiner* — Carla J Therrien
(74) *Attorney, Agent, or Firm* — VENABLE LLP

(57) ABSTRACT

An optical print head includes a substrate on which a plurality of light emitting elements is mounted; a lens configured to condense light emitted from the light emitting elements on a photoreceptor; a holding member configured to hold the substrate and the lens; and an attachment portion configured to be provided on the holding member, provided outside an end portion of the substrate in a longitudinal direction of the substrate, and provided with a moving mechanism that moves the holding member to an exposure position at which the photoreceptor is exposed and a separation position at which the holding member is separated from the photoreceptor with respect to the exposure position. A wall portion is provided between the end portion of the substrate and the attachment portion in the longitudinal direction, and a sealing material is applied so as to be in contact with the substrate and the wall portion.

9 Claims, 17 Drawing Sheets

OPTICAL PRINT HEAD AND IMAGE FORMING APPARATUS

BACKGROUND OF THE INVENTION

Field of the Invention

The present invention relates to an optical print head that exposes a photoreceptor and an image forming apparatus of an electrophotographic system such as a digital copying machine or a facsimile apparatus including the optical print head.

Description of the Related Art

Conventionally, as an image forming apparatus of an electrophotographic system, for example, an image forming apparatus that forms an electrostatic latent image on a surface of a photoreceptor by an exposure apparatus including an LED array and a lens array and develops a toner image by attaching toner to the electrostatic latent image, has been widely used.

In this exposure apparatus, when foreign matter such as toner enters a space around the LED array and the lens array, there is a possibility that a problem such as a reduction in light quantity occurs. Therefore, a technique described in Japanese Patent Application Laid-Open No. 2012-66499 is known.

In the exposure apparatus described in Japanese Patent Application Laid-Open No. 2012-66499, a sealing material is applied to a gap between a base holding a substrate on which an LED array is mounted and a holder made of a U-shaped steel plate, and shielding plates are disposed at both end portions of the base in a longitudinal direction. In this way, entry of foreign matter through the gap between the base and the holder and from both ends of the holder is prevented.

However, in the technique of Japanese Patent Application Laid-Open No. 2012-66499, it is difficult to dispose the shielding plates at both end portions of the base in the longitudinal direction without a gap between the base and the holder, and the sealability is not sufficient.

On the other hand, in a technique of Japanese Patent Application Laid-Open No. 2021-74943, a substrate on which an LED array is mounted is directly held by a holder made of a U-shaped steel plate, and a sealing material is applied to a gap between the substrate and the holder. For this reason, in order to prevent entry of foreign matter from the end portion of the substrate in the longitudinal direction, it is conceivable to seal the end portion of the substrate with a sealing material. However, since there is no wall, when the end portion of the substrate is to be sealed with the sealing material, there is a possibility that the sealing material flows into the LED array mounted on the substrate before being cured.

SUMMARY OF THE INVENTION

It is desirable to suppress inflow of a sealing material to an LED array mounted on a substrate.

A representative configuration of the present invention includes: a substrate on which a plurality of light emitting elements is mounted; a lens configured to condense light emitted from the light emitting elements on a photoreceptor; a holding member configured to hold the substrate and the lens; and an attachment portion configured to be provided on the holding member, provided outside an end portion of the substrate in a longitudinal direction of the substrate, and provided with a moving mechanism that moves the holding member to an exposure position at which the photoreceptor is exposed and a separation position at which the holding member is separated from the photoreceptor with respect to the exposure position, in which a wall portion is provided between the end portion of the substrate and the attachment portion in the longitudinal direction, and a sealing material is applied so as to be in contact with the substrate and the wall portion.

Further features of the present invention will become apparent from the following description of exemplary embodiments with reference to the attached drawings.

DESCRIPTION OF THE EMBODIMENTS

Hereinafter, exemplary embodiments for carrying out the present invention will be described with reference to the accompanying drawings. However, the components described in the present description are merely examples, and the present invention is not limited to the embodiments described in the present description.

Example 1

Image Forming Apparatus

Figure 1:
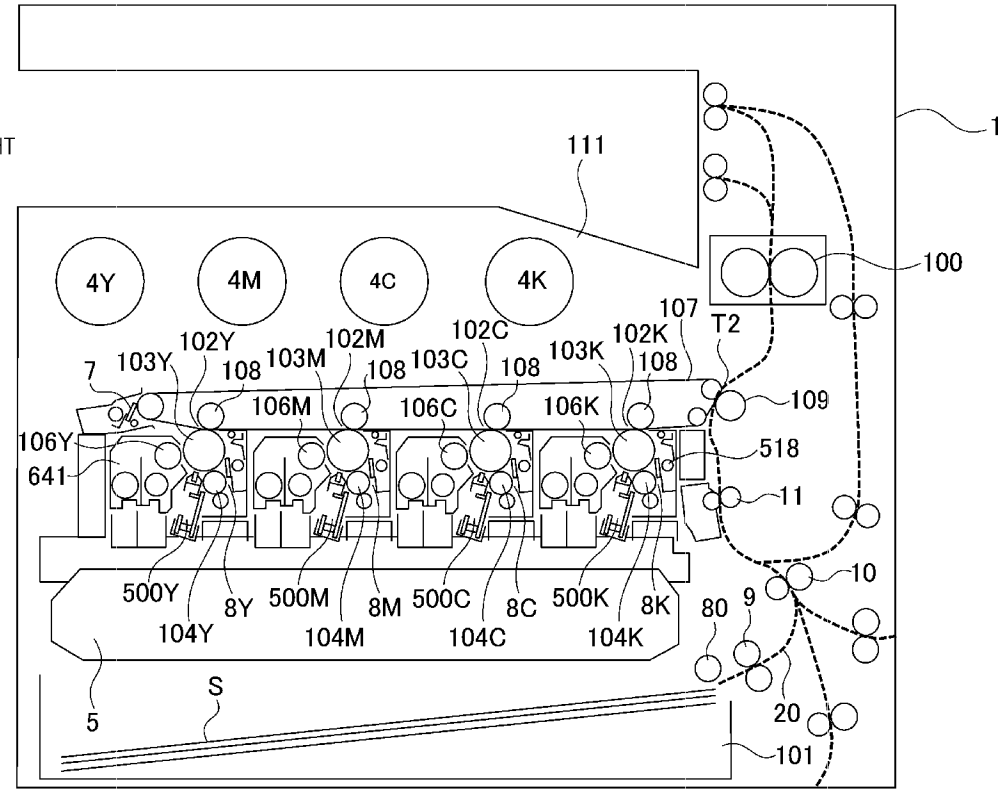
FIG. 1 is a cross-sectional view of an image forming apparatus.

First, a schematic configuration of an image forming apparatus 1 will be described. FIG. 1 is a schematic cross-sectional view of the image forming apparatus 1. The image forming apparatus 1 illustrated in FIG. 1 is a color printer including a reading apparatus (multi-function printer (MFP)), but the embodiment may be a printer not including a reading apparatus. In addition, the embodiment is not limited to a so-called color image forming apparatus of a tandem system including a plurality of photoreceptor drums 103 as illustrated in FIG. 1, but may be a color image forming apparatus including one photoreceptor drum 103 or an image forming apparatus that forms a monochrome image.

The image forming apparatus 1 illustrated in FIG. 1 includes four image forming portions 102Y, 102M, 102C, and 102K (hereinafter, also collectively and simply referred to as an "image forming portion 102") that form toner images of respective colors of yellow, magenta, cyan, and black. In addition, the image forming portions 102Y, 102M, 102C, and 102K include photoreceptor drums 103Y, 103M, 103C, and 103K (hereinafter, also collectively and simply referred to as a "photoreceptor drum 103"), which are photoreceptors (image bearing members), respectively. These photoreceptor drums are arranged apart from each other. In addition, the image forming portions 102Y, 102M, 102C, and 102K include chargers 104Y, 104M, 104C, and 104K (hereinafter, also collectively and simply referred to as a "charger 104"), which are charging portions for respectively charging the photoreceptor drums 103Y, 103M, 103C, and 103K. In addition, the image forming portions 102Y, 102M, 102C, and 102K include light emitting diode (hereinafter referred to as LED) exposure units 500Y, 500M, 500C, and 500K (hereinafter, also collectively and simply referred to as an "exposure unit 500"), which are exposure light sources that emit light for exposing the photoreceptor drums 103Y, 103M, 103C, and 103K. Further, the image forming portions 102Y, 102M, 102C, and 102K include developing devices 106Y, 106M, 106C, and 106K (hereinafter, also collectively and simply referred to as a "developing device 106"), which are developing units for developing an electrostatic latent image on the photoreceptor drum 103 with toner and developing a toner image of each color on the photoreceptor drum 103. Note that Y, M, C, and K attached to the reference numerals indicate the colors of the toner.

The image forming apparatus 1 illustrated in FIG. 1(*a*) is an image forming apparatus that adopts a so-called "lower surface exposure system" that exposes the photoreceptor drum 103 from below. Hereinafter, description will be given on the premise of an image forming apparatus adopting a lower surface exposure system. Note that, although not illustrated, an image forming apparatus adopting an "upper surface exposure system" that exposes the photoreceptor drum from above may be used as an embodiment.

The image forming apparatus 1 includes an intermediate transfer belt 107 to which a toner image formed on the photoreceptor drum 103 is transferred, and primary transfer rollers 108 (Y, M, C, and K) that sequentially transfer the toner image formed on the photoreceptor drum 103 to the intermediate transfer belt 107. In addition, the image forming apparatus 1 includes a secondary transfer roller 109 that transfers the toner image on the intermediate transfer belt 107 to a recording material S conveyed from a sheet feeding portion 101, and a fixing device 100 that fixes the secondarily transferred image to the recording material S. Note that, in addition to the intermediate transfer system using the intermediate transfer belt 107 described above, a direct transfer system of directly transferring from the photoreceptor drum 103 to a recording material may be used.

Toner remains on the surfaces of the photoreceptor drums 103Y, 103M, 103C, and 103K after the primary transfer. The residual toner is removed by drum cleaning apparatuses (first cleaning apparatuses) 8Y, 8M, 8C, and 8K (hereinafter, also collectively and simply referred to as a "drum cleaning apparatus 8"), and are collected in a collected toner container 5.

In addition, the toner also remains on the surface of the intermediate transfer belt 107 after the secondary transfer. The residual toner is removed by a belt cleaning apparatus (second cleaning apparatus) 7 and collected in the collected toner container 5.

Image Forming Process

Next, an image forming process of the image forming apparatus described above will be briefly described. The charger 104Y charges the surface of the photoreceptor drum 103Y. The exposure unit 500Y exposes the surface of the photoreceptor drum 103Y charged by the charger 104Y. Thus, an electrostatic latent image is formed on the photoreceptor drum 103Y. Next, the developing device 106Y develops the electrostatic latent image formed on the photoreceptor drum 103Y with yellow toner. The yellow toner image developed on the surface of the photoreceptor drum 103Y is transferred onto the intermediate transfer belt 107 by the primary transfer roller 108Y. Magenta, cyan, and black toner images are also transferred to the intermediate transfer belt 107 in a similar image forming process.

The toner image of each color transferred onto the intermediate transfer belt 107 is conveyed to a secondary transfer portion T2 by the intermediate transfer belt 107. A transfer bias for transferring the toner image to the recording material S is applied to the secondary transfer roller 109 disposed at the secondary transfer portion T2. The toner image conveyed to the secondary transfer portion T2 is transferred to the recording material S conveyed from the sheet feeding portion (sheet feeding cassette) 101 by the transfer bias of the secondary transfer roller 109.

The recording material S is stored in a form of being stacked in the sheet feeding portion 101, and is fed to a conveyance path 20 according to an image forming timing. In the sheet feeding method, first, the leading end of the recording material S is flipped up by friction of a sheet feeding roller 80, and only one sheet of the recording material S is conveyed to the conveyance path 20 by a pair of sheet separation conveying rollers 9 for preventing double feeding of the recording material S. Thereafter, the recording material S pulled out by a pair of conveying rollers 10 is conveyed to a pair of registration rollers 11 through the conveyance path 20 and temporarily stopped. Note that the pair of registration rollers 11 perform skew feeding correction and timing correction, and then the recording material S is conveyed to the secondary transfer portion T2.

The recording material S to which the toner image has been transferred by the secondary transfer portion T2 is conveyed to the fixing device 100. The fixing device 100 fixes the toner image on the recording material S by heat and pressure. The recording material S subjected to the fixing processing by the fixing device 100 is discharged to a sheet discharging portion 111.

In addition, as illustrated in FIG. 1, the image forming apparatus 1 includes toner containers 4Y, 4M, 4C, and 4K (hereinafter, also collectively and simply referred to as a "toner container 4"). By performing the image formation, the toner amount in a developing unit 641 (described later) decreases. At that time, the toner is supplied from the toner containers 4Y, 4M, 4C, and 4K provided corresponding to the respective image forming portions 102Y, 102M, 102C, and 102K to the developing unit 641 (described later) via pipes, which are not illustrated. That is, in the developing unit 641 (described later) included in the image forming apparatus 1 described in the present example, while new toner is replenished from the toner container 4, a part of the excessive toner is conveyed as residual toner to the collected toner container 5.

Drum Unit and Developing Unit

A drum unit 518, which is an example of a replaceable replacement unit, is attached to the image forming apparatus 1 of the present example. The drum unit 518 is a cartridge to be replaced by an operator such as a user or a maintenance person. The drum unit 518 (Y, M, C, and K) of the present example includes the photoreceptor drum 103 (Y, M, C, and K) rotatably supported with respect to the frame body of the drum unit 518.

In addition, the developing unit 641, which is separate from the drum unit 518, is attached to the image forming apparatus 1 of the present example. The developing unit 641 of the present example is a cartridge in which the developing device 106 and a toner storage portion illustrated in FIG. 1 are integrated. The developing device 106 includes a developing sleeve that is a developer bearing member that bears a developer. The developing unit 641 is provided with a plurality of gears for rotating screws for stirring the toner and the carrier. When these gears deteriorate over time or the like, the operator detaches and replaces the developing unit 641 from the apparatus body of the image forming apparatus 1. In addition, a certain amount of toner is removed as residual toner from the developing unit 641, and is conveyed to the collected toner container 5. Note that the embodiment of the drum unit 518 and the developing unit 641 may be a process cartridge in which the drum unit 518 and the developing unit 641 described above are integrated.

Figure 2:
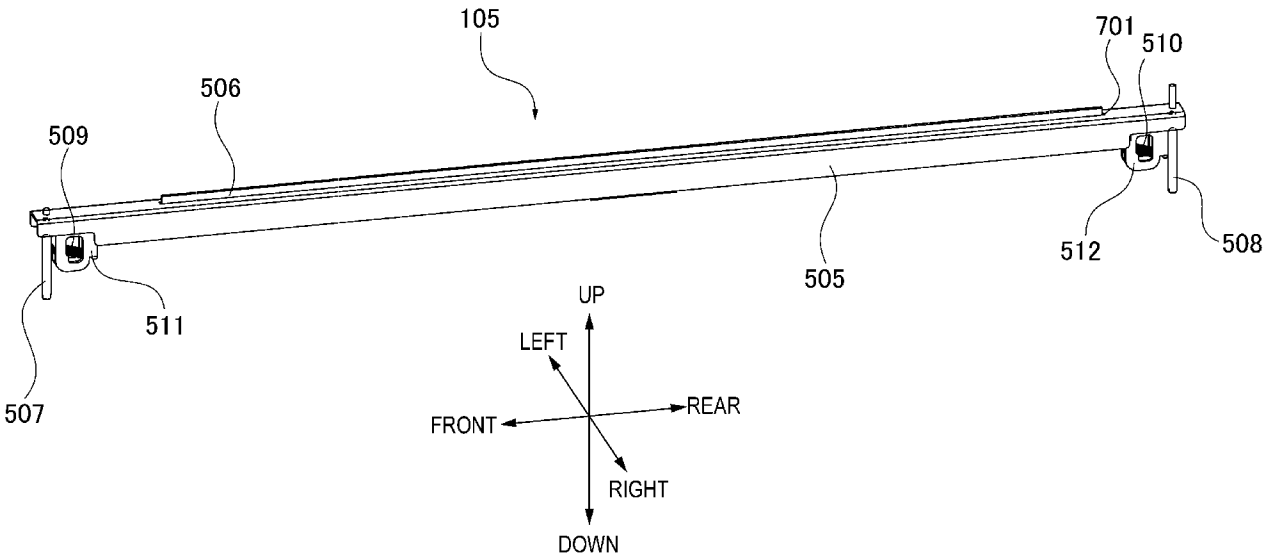
FIG. 2 is a perspective view of an optical print head.

Here, as illustrated in FIG. 1, in the following description, one side in a direction in which the drum unit 518 is inserted into and removed from the image forming apparatus 1 is defined as a front side (near side or front face side), and the other side is defined as a rear side (back side or back face side). In addition, when the photoreceptor drum 103K on which the electrostatic latent image related to the black toner image is formed is used as a reference, the side on which the photoreceptor drum 103Y on which the electrostatic latent image related to the yellow toner image is formed is disposed is defined as the left side. When the photoreceptor drum 103Y on which the electrostatic latent image related to the yellow toner image is formed is used as a reference, the side on which the photoreceptor drum 103K on which the electrostatic latent image related to the black toner image is formed is disposed is defined as the right side. Further, a direction perpendicular to the front-rear direction and the left-right direction defined here and upward in the vertical direction is defined as an upward direction, and a direction perpendicular to the front-rear direction and the left-right direction defined here and downward in the vertical direction is defined as a downward direction. The defined front direction, rear direction, right direction, left direction, upward direction, and downward direction are illustrated in FIG. 2.

Note that, in the following description, the rotational axis direction of the photoreceptor drum 103 is a direction that coincides with the front-rear direction illustrated in FIG. 2. In addition, the longitudinal direction of an optical print head 105 is also a direction that coincides with the front-rear direction illustrated in FIG. 2. That is, the rotational axis direction of the photoreceptor drum 103 and the longitudinal direction of the optical print head 105 are directions that coincide with each other. In addition, one end side in the rotational axis direction of the photoreceptor drum 103 means the front side defined herein, and the other end side means the rear side defined herein. One end side and the other end side in the front-rear direction also correspond to the front side and the rear side defined herein. One end side in the left-right direction means the right side defined herein, and the other end side means the left side defined herein.

Exposure Unit

Next, an exposure unit 520 including the optical print head 105 will be described with reference to FIGS. 2 to 5.

Figure 4:
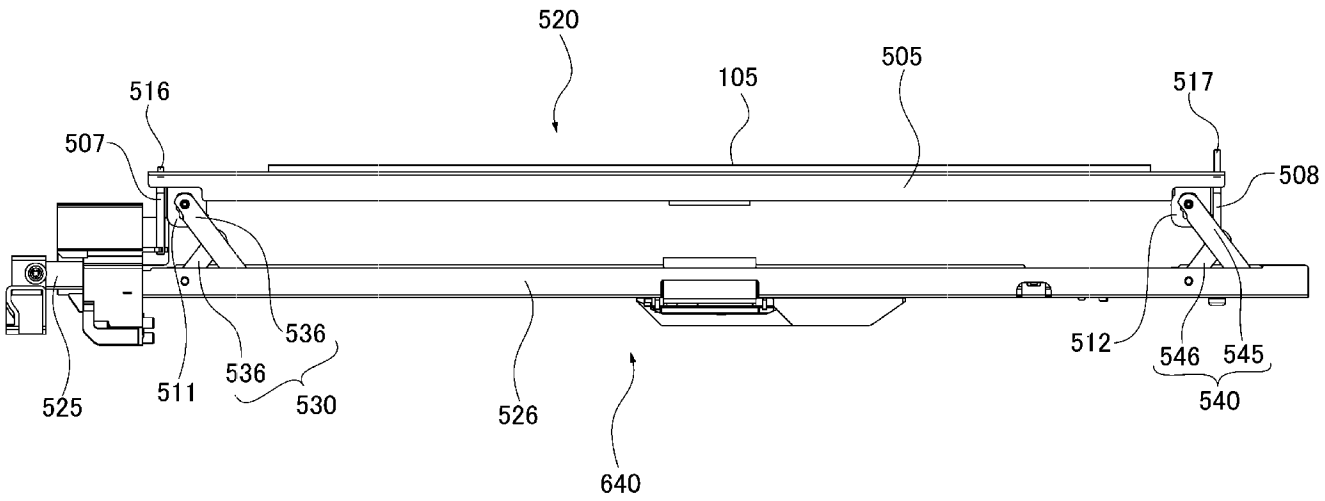
FIG. 4 is a side view of an optical print head.
Figure 5:
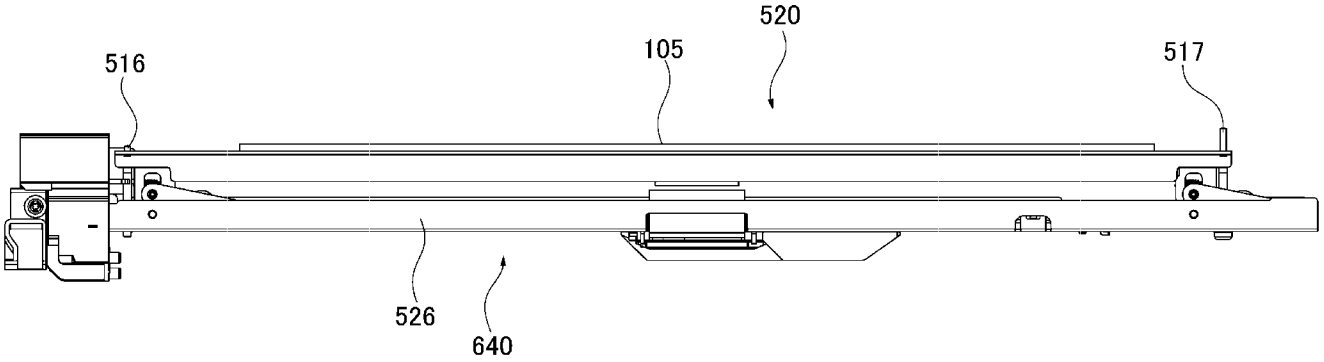
FIG. 5 is a side view of an optical print head.

As illustrated in FIGS. 4 and 5, the exposure unit 520 includes the optical print head 105 that exposes the photoreceptor drum 103, and a moving mechanism 640 that moves the optical print head 105 to an exposure position at which the photoreceptor drum 103 is exposed and a separation position at which the optical print head 105 is separated from the photoreceptor drum 103 with respect to the exposure position.

Optical Print Head

Next, the optical print head 105 included in the exposure unit 500 will be described. Here, as an example of an exposure system adopted in an image forming apparatus of an electrophotographic system, there is a laser beam scanning exposure system in which an irradiation beam of a semiconductor laser is scanned with a rotating polygon mirror or the like and a photoreceptor drum is exposed through an f-θ lens or the like. The "optical print head 105" described in the present example is used for an LED exposure system that exposes the photoreceptor drum 103 by using light emitting elements such as LEDs arranged along the rotational axis direction of the photoreceptor drum 103, and is not used for the laser beam scanning exposure system described above.

The optical print head 105 described in the present example is provided below the rotational axis of the photoreceptor drum 103 in the vertical direction, and LEDs 503 of the optical print head 105 expose the photoreceptor drum 103 from below. FIG. 2 is a schematic perspective view of the optical print head 105 included in the image forming apparatus 1 of the present example.

The optical print head 105 has an elongated shape (longitudinal shape) extending in the rotational axis direction of the photoreceptor drum 103. In addition, the optical print head 105 includes a holding member 505 (an example of a holder), a lens array 506, and a substrate 502 (see FIG. 3). In addition, the holding member 505 includes a pin front 507 and a pin rear 508, which are abutment members, and a spring holder front 511 and a spring holder rear 512 that hold a spring front 509 and a spring rear 510. The holding member 505 holds the substrate 502 and the lens array 506.

Figure 3A:
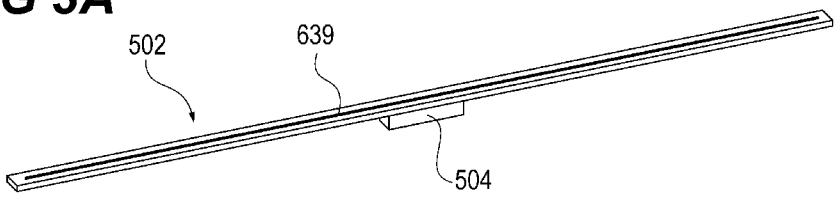
FIGS. 3A, 3B, 3C, 3D, and 3E are explanatory views of a substrate and a lens array.
Figure 3B:
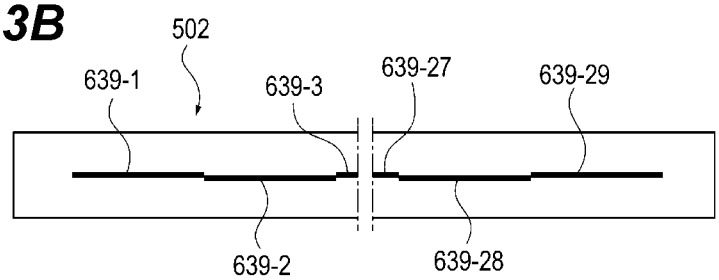
Figure 3C:
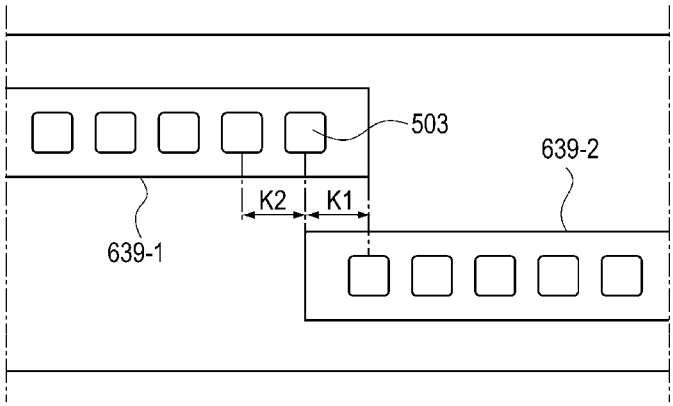

Next, the substrate 502 will be described. FIG. 3A is a schematic perspective view of the substrate 502 in the optical print head 105. FIG. 3B is a view illustrating an arrangement of a plurality of LEDs 503 provided on the substrate 502, and FIG. 3C is an enlarged view of FIG. 3B.

LED chips 639 are mounted on the substrate 502. As illustrated in FIG. 3A, an LED chip 639 is provided on one surface of the substrate 502, and a long FFC connector 504 is provided on the other surface (surface opposite to the side on which the light emitting elements are arranged). The FFC connector 504 is attached to the lower surface of the substrate 502 such that the longitudinal direction thereof is along the longitudinal direction of the substrate 502. Wiring for supplying a signal to each LED chip 639 is provided on the substrate 502. One end of a flexible flat cable (FFC, not illustrated) as an example of a cable is connected to the connector 504.

Although not illustrated, the image forming apparatus 1 is provided with a substrate including a controller and a connector. The other end of the FFC is connected to the connector. That is, the FFC electrically connects the controller and the substrate 502. A control signal (drive signal) is input from the controller of the image forming apparatus 1 to the substrate 502 via the FFC and the connector 504. The LED chips 639 are driven by a control signal input to the substrate 502.

The LED chips 639 mounted on the substrate 502 will be described in more detail. As illustrated in FIGS. 3B and 3C, a plurality of LED chips 639-1 to 639-29 (29) in which a plurality of LEDs 503 (an example of a light emitting element) is disposed are arranged on one surface of the substrate 502. In each of the LED chips 639-1 to 639-29, 516 LEDs 503 are arranged in a line in the longitudinal direction thereof. In the longitudinal direction of the LED chip 639, a center-to-center distance k2 between the adjacent LEDs 503 corresponds to the resolution of the image forming apparatus 1. Since the resolution of the image forming apparatus 1 of the present example is 1200 dpi, the LEDs 503 are arranged in a line such that the center-to-center distance between the adjacent LEDs 503 is 21.16 μm in the longitudinal direction of the LED chips 639-1 to 639-29. Therefore, the exposure range of the optical print head 105 of the present example is about 314 mm. The photosensitive layer of the photoreceptor drum 103 is formed to have a width of 314 mm or more. Since the length of the long side of an A4-size recording sheet and the length of the short side of an A3-size recording sheet are 297 mm, the optical print head 105 of the present example has an exposure range in which an image can be formed on the A4-size recording sheet and the A3-size recording sheet.

The LED chips 639-1 to 639-29 are alternately disposed in two lines along the rotational axis direction of the photoreceptor drum 103. That is, as illustrated in FIG. 3B, odd-numbered LED chips 639-1, 639-3, . . . 639-29 counted from the left side are mounted along one line in the longitudinal direction of the substrate 502. In addition, even-numbered LED chips 639-2, 639-4, . . . 639-28 counted from the left side are mounted along another line in the longitudinal direction of the substrate 502. By disposing the LED chips 639 in this way, as illustrated in FIG. 3C, in the longitudinal direction of the LED chip 639, a center-to-center distance k1 of the LEDs 503 disposed at one end of one LED chip 639 and the other end of the other LED chip 639 in different adjacent LED chips 639 can be made equal to the center-to-center distance k2 of the adjacent LEDs 503 on the one LED chip 639.

Note that, in the present example, the light emitting element is a semiconductor LED which is a light emitting diode, but may be, for example, an organic light emitting diode (OLED). This OLED is also called organic electroluminescence (EL), and is a current-driven light emitting element. The OLEDs are disposed on a line along a main scanning direction (a rotational axis direction of the photoreceptor drum 103) on a thin film transistor (TFT) substrate, for example, and are electrically connected in parallel by power supply wiring similarly provided along the main scanning direction.

Figure 3D:
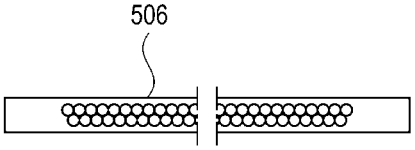
Figure 3E:
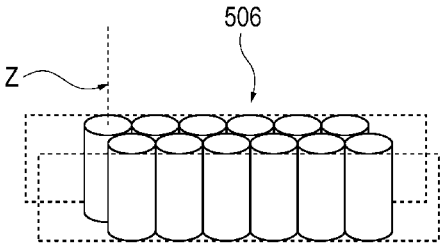

Next, the lens array 506 will be described. FIG. 3D is a schematic view of the lens array 506 as viewed from the photoreceptor drum 103 side. In addition, FIG. 3E is a schematic perspective view of the lens array 506. As illustrated in FIG. 3D, a plurality of lenses is arranged in two lines along the arrangement direction of the plurality of LEDs 503. The lenses are alternately disposed such that one of the lenses in one line is disposed so as to be in contact with both of adjacent lenses in the arrangement direction of the lenses in the other line. Each lens is a cylindrical rod lens made of glass. Note that the material of the lens is not limited to glass, but may be plastic. The shape of the lens is not limited to the cylindrical shape, but may be, for example, a polygonal prism such as a hexagonal prism.

A dotted line Z illustrated in FIG. 3E indicates the optical axis of the lens. The optical print head 105 is movable in a direction (up-down direction) substantially along the optical axis of the lens indicated by the dotted line Z by the moving mechanism 640 (see FIGS. 4 and 5) to be described later. The optical axis of the lens here means a line connecting the center of the light emitting surface of the lens and the focal point of the lens. The radiation light emitted from the LEDs 503 is incident on the lenses included in the lens array 506. The lens has a function of condensing the incident radiation light on the surface of the photoreceptor drum 103. The attachment position of the lens array 506 with respect to an opening 701 (see FIG. 2) is adjusted at the time of assembling the optical print head 105 such that the distance between the light emission surface of the LED 503 and the light incident surface of the lens is substantially equal to the distance between the light emitting surface of the lens and the surface of the photoreceptor drum 103.

Moving Mechanism

Next, the moving mechanism 640 for moving the optical print head 105 to the exposure position with respect to the photoreceptor drum 103 and the separation position at which the optical print head 105 is separated from the photoreceptor drum 103 with respect to the exposure position will be described. The optical print head 105 is disposed close to the photoreceptor drum 103 and has a function of exposing the photoreceptor drum 103. Therefore, when the drum unit 518 is taken out from the image forming apparatus 1 for maintenance or the like of the image forming apparatus 1, when the optical print head 105 remains at the exposure position, the optical print head 105 may become an obstacle to remove the drum unit 518. Thus, the optical print head 105, which is at the exposure position closer to the photoreceptor drum at the time of exposure, is required to have a moving function of moving to the separation position at which the optical print head 105 is separated from the photoreceptor drum with respect to the exposure position at the time of maintenance of the image forming apparatus 1.

FIG. 4 is a side view of the exposure unit 500 when the optical print head 105 is at the exposure position. FIG. 4 is a view seen from the right side. In addition, a corresponding side view of the exposure unit 500 when the optical print head 105 is at the separation position is FIG. 5. Note that, although the drum unit 518 is not illustrated, when the optical print head 105 is at the exposure position illustrated in FIG. 4, a pin front 516 and a pin rear 517 provided at both end portions in the front-rear direction are in contact with predetermined portions of the drum unit 518 supporting the photoreceptor drum 103. At this time, an upward biasing force by the spring front 509 and the spring rear 510 (see FIG. 2) held by the spring holder front 511 and the spring holder rear 512 is applied to the optical print head 105. The pin front 516, the pin rear 517, the spring holder front 511, and the spring holder rear 512 are provided on the holding member 505. The spring front 509 and the spring rear 510 are biasing members that apply a force to the optical print head 105 in the direction of the photoreceptor drum 103, and are held by the spring holder front 511 and the spring holder rear 512. The force is applied to the optical print head 105 in the direction of the photoreceptor drum 103 by the spring front 509 and the spring rear 510, which are biasing members, and the pin front 516 and the pin rear 517 are both brought into contact with the drum unit 518. Thus, the distance between the optical print head 105 and the surface of the photoreceptor drum 103 is kept constant at the exposure position.

As illustrated in FIGS. 4 and 5, the moving mechanism 640 that moves the optical print head 105 to the exposure position and the separation position includes a frame 526, which is a support member, a slide member 525, a first link mechanism 530, and a second link mechanism 540.

The frame 526 is formed by bending a sheet metal into a U-shape by press working. The frame 526 is a member having a longitudinal shape extending in the rotational axis direction of the photoreceptor drum 103. One end side (near side) of the frame 526 in the longitudinal direction is fixed to a front plate (not illustrated) of the image forming apparatus 1, and the other end side (back side) of the frame 526 in the longitudinal direction is fixed to a rear plate (not illustrated) of the image forming apparatus 1. In this way, the position of the frame 526 with respect to the photoreceptor drum 103 is fixed on the side opposite to the side where the photoreceptor drum 103 is disposed with respect to the holding member 505.

The frame 526 includes the slide member (moving member) 525 movable in the longitudinal direction of the frame 526. As the slide member 525 moves in the front-rear direction with respect to the frame 526, the link mechanisms 530 and 540 pivot, and the optical print head 105 moves in the up-down direction.

The first link mechanism 530 includes a link member 535 that couples the spring holder front 511 and the slide member 525, and a link member 536 that couples the link member 535 and the frame 526. The second link mechanism 540 includes a link member 545 that couples the spring holder rear 512 and the slide member 525, and a link member 546 that couples the link member 545 and the frame 526. The first link mechanism 530 is attached to the front side with respect to the center of the holding member 505 in the rotational axis direction of the photoreceptor drum 103, and the second link mechanism 540 is attached to the rear side with respect to the center of the holding member 505 in the rotational axis direction of the photoreceptor drum 103.

Along with an opening/closing operation of a cover (not illustrated) provided on the near side of the image forming apparatus 1, the slide member 525 moves in a sliding manner in the front-rear direction with respect to the frame 526. Each link member 535, 536, 545, and 546 pivots in conjunction with the sliding movement of the slide member 525, and the optical print head 105 moves in the up-down direction.

In the present example, as illustrated in FIG. 4, when the slide member 525 is moved to the front side in the front-rear direction with respect to the frame 526, each link member 535, 536, 545, and 546 pivots in conjunction therewith, and the optical print head 105 rises to the exposure position. On the other hand, as illustrated in FIG. 5, when the slide member 525 is moved to the rear side in the front-rear direction with respect to the frame 526, each link member 535, 536, 545, and 546 pivots in conjunction therewith, and the optical print head 105 descends to the separation position.

Countermeasure Against Entry Of Foreign Matter Into Optical Print Head

Next, countermeasures against entry of foreign matter into the optical print head 105 of the present example will be described.

Figure 6:
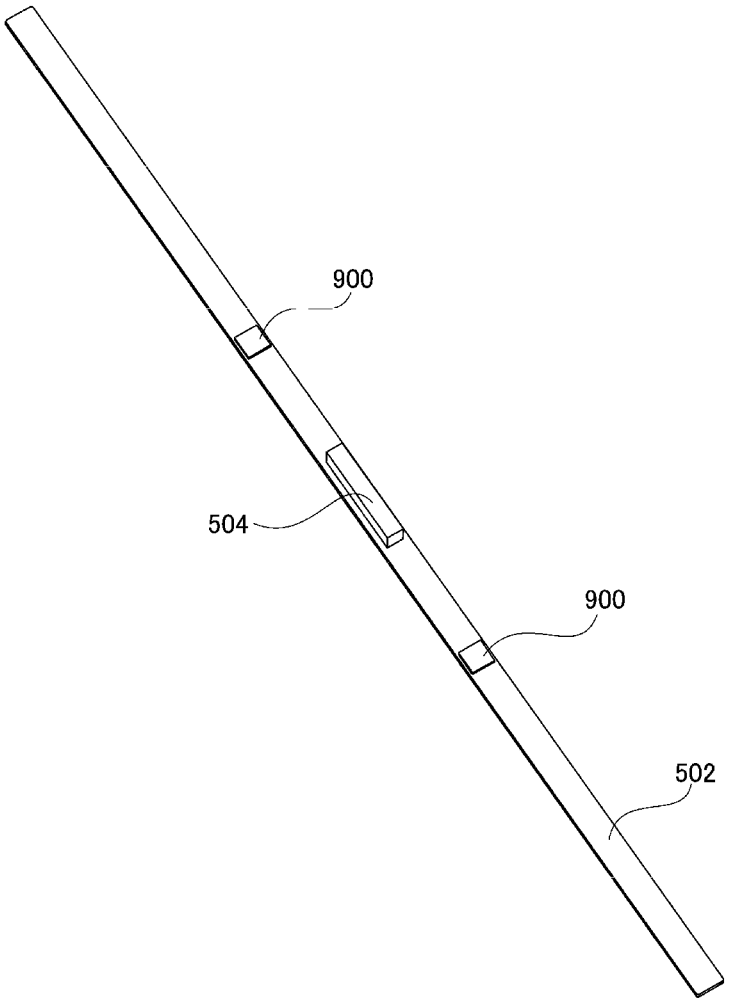
FIG. 6 is a perspective view of a substrate.

FIG. 6 is a perspective view illustrating the substrate 502 on which the LEDs 503 are mounted. This drawing is a perspective view from a direction in which the FFC connector 504 is mounted, and the LEDs 503 are mounted on the other surface. Driver ICs 900 for causing the LEDs 503 to emit light or controlling the LEDs 503 are mounted at both ends of the FFC connector 504. Note that, in order to simplify the description, other mounting components such as resistors and capacitors are not illustrated. The driver IC 900 used in the present example is an IC chip having a size of 8 mm square and a thickness of 0.85 mm, and a plurality of electrode pads on the back surface of the IC chip and electrodes on the substrate 502 are electrically connected by solder.

Figure 7:
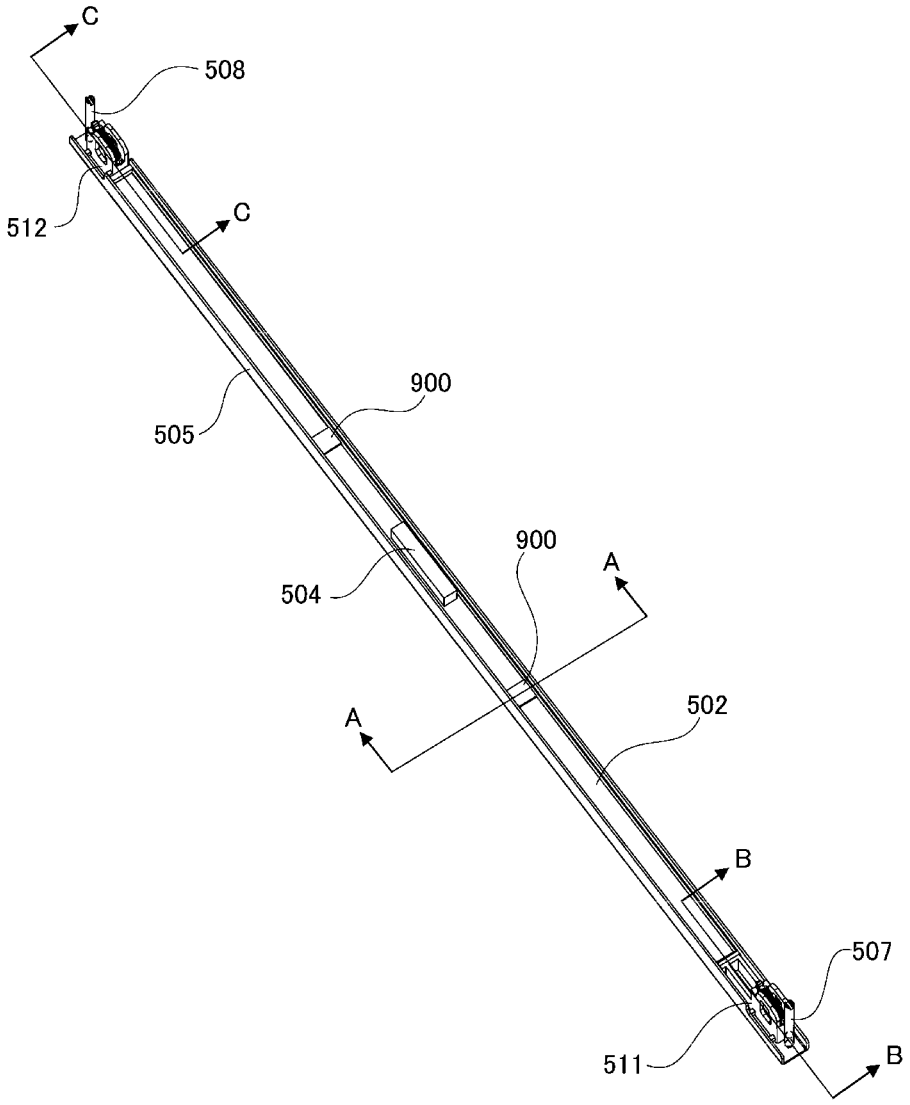
FIG. 7 is a perspective view of an optical print head.
Figure 8:
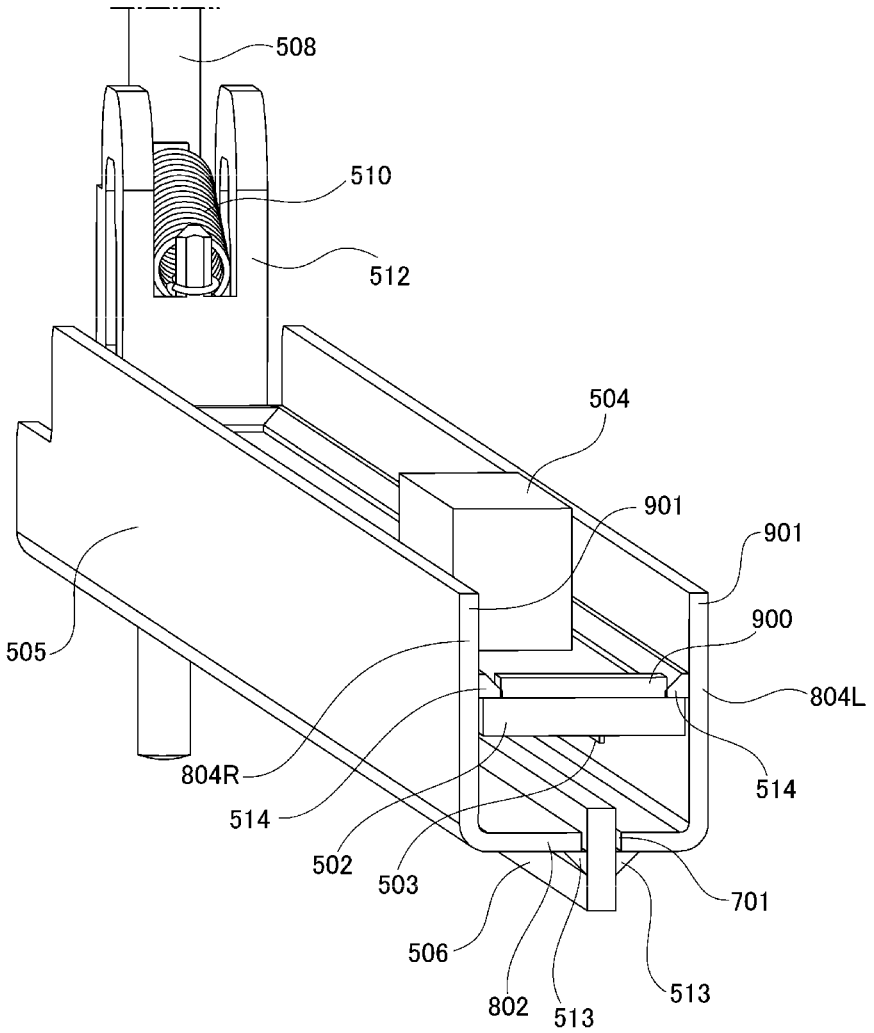
FIG. 8 is a cross-sectional perspective view of an optical print head.
Figure 9:
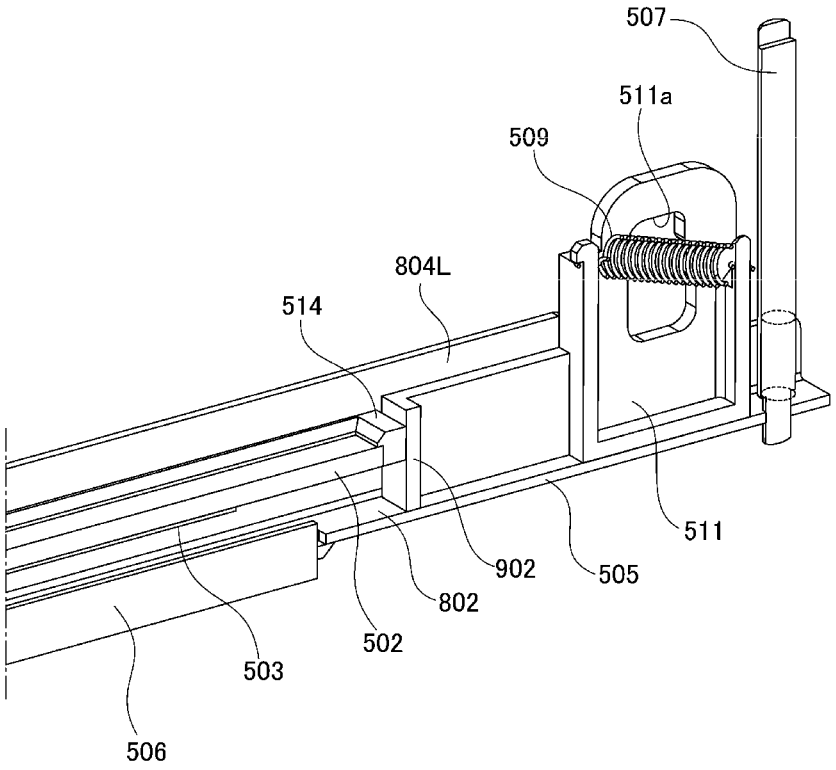
FIG. 9 is a cross-sectional perspective view of an optical print head.
Figure 10:
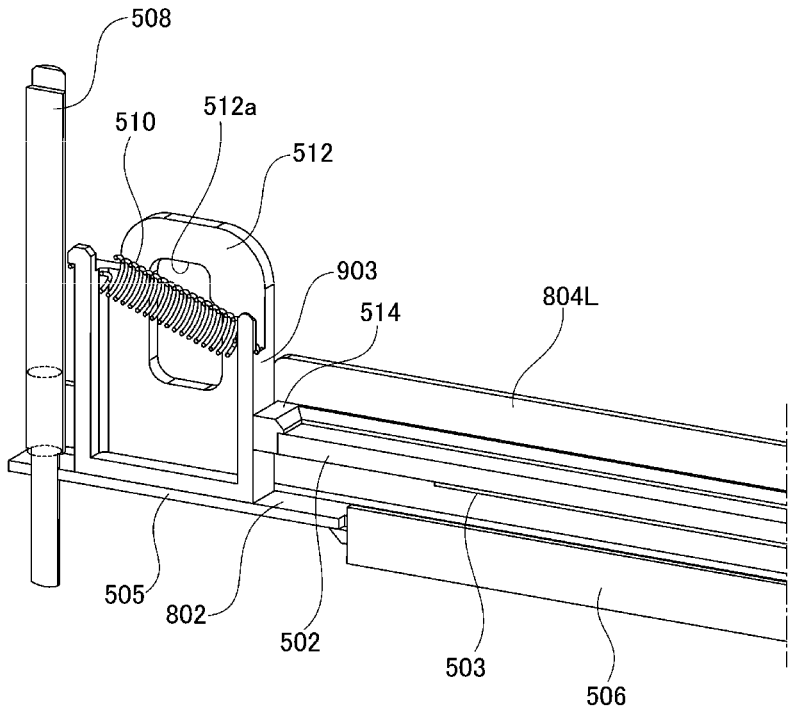
FIG. 10 is a cross-sectional perspective view of an optical print head.

FIG. 7 is a perspective view illustrating a state in which the substrate 502, the lens array 506 (not illustrated in FIG. 7), the spring holder front 511, and the spring holder rear 512 are held by the holding member 505. FIG. 8 is a cross-sectional perspective view when cut on the driver IC 900 (a portion indicated by an arrow A-A in the drawing) in FIG. 7. In addition, FIG. 9 is a cross-sectional perspective view when cut at the spring holder front 511 (a portion indicated by an arrow B-B in the drawing) in FIG. 7. In addition, FIG. 10 is a cross-sectional perspective view when cut at the spring holder rear 512 (a portion indicated by an arrow C-C in the drawing) in FIG. 7.

Here, the holding member 505 in the present example is a thin plate made of metal and having a thickness of about 1 mm, and is a part obtained by processing an electrogalvanized steel plate with a press die. As described above, the holding member 505 is provided with the pin front 507 and the pin rear 508 as abutment members at both end portions in the longitudinal direction, and not formed into a box shape with four sides being bent, but formed in a U-shape by press working. Hereinafter, the shape of the holding member 505 will be described.

The holding member 505 includes a base portion 802 in which the opening 701 into which the lens array 506 is inserted is formed. In addition, the holding member 505 has a first extending portion 804R extending in a direction away from the photoreceptor drum 103 from one side in a lateral direction orthogonal to the longitudinal direction of the base portion 802. In addition, the holding member 505 has a second extending portion 804L extending in a direction away from the photoreceptor drum 103 from the other side in the lateral direction of the base portion 802. The extending portion 804R and the extending portion 804L form a substrate holding portion for holding the substrate 502 inserted from between the extending portion 804R and the extending portion 804L in the holding member 505. The base portion 802, the first extending portion 804R, and the second extending portion 804L are integrated, form the holding member 505 that holds the lens array 506 and the substrate 502, and are formed in a substantially U-shape.

In addition, as described above, the holding member 505 includes the pin front 516 and the pin rear 517, which are abutment members, and the spring holder front 511 and the spring holder rear 512, which are attachment members. In the rotational axis direction of the photoreceptor drum 103 (the longitudinal direction of the substrate), the photosensitive layer of the photoreceptor drum 103 is formed to have a width equal to or larger than the exposure range of the optical print head 105. In addition, although not illustrated, the pin front 516 and the pin rear 517 are in contact with the outside of the photoreceptor drum 103 of the drum unit 518. Therefore, the spring holder front 511 and the spring holder rear 512 are disposed between both end portions of the substrate 502 in the longitudinal direction and the pin front 507 and the pin rear 508, respectively. As described above, the spring holder front 511 and the spring holder rear 512 are connected to the link members 535 and 545, respectively, and are adhesively fixed to predetermined positions of the holding member 505. By separating the spring holder front 511 and the spring holder rear 512 from the holding member 505, the manufacturing cost of the holding member 505 can be suppressed relatively inexpensively.

The spring holder front 511 and the spring holder rear 512 are provided on the holding member 505. The spring holder front 511 and the spring holder rear 512 are provided outside the end portions of the substrate 502 in the longitudinal direction of the substrate 502. The spring holder front 511 and the spring holder rear 512 include, respectively, an attachment portion front 511*a* and an attachment portion rear 512*a* to which the moving mechanism 640 for moving the holding member 505 to the exposure position and the separation position (retracted position) is attached. Specifically, the spring holder front 511 includes the attachment portion front 511*a* to which the link member 535 of the first link mechanism 530 is attached. The spring holder rear 512 includes the attachment portion rear 512*a* to which the link member 545 of the second link mechanism 540 is attached.

In addition, as described above, the spring holder front 511 and the spring holder rear 512 hold the spring front 509 and the spring rear 510, which are biasing members that apply a force to the optical print head 105 in the direction of the photoreceptor drum 103.

The spring holder front 511 is provided with a wall portion front 902 between the end portion of the substrate 502 and the attachment portion front 511*a* in the longitudinal direction. The spring holder rear 512 is provided with a wall portion rear 903 between the end portion of the substrate 502 and the attachment portion rear 512*a* in the longitudinal direction. That is, in the present example, the spring holder front 511 is an attachment member in which the attachment portion front 511*a* and the wall portion front 902 are integrally molded by resin, and is held by the holding member 505 outside the end portion of the substrate 502 in the longitudinal direction. The spring holder rear 512 is an attachment member in which the attachment portion rear 512*a* and the wall portion rear 903 are integrally molded by resin, and is held by the holding member 505 outside the end portion of the substrate 502 in the longitudinal direction.

Note that, in the present example, the configuration in which the attachment portion front 511*a* and the wall portion front 902 are integrally molded as the spring holder front 511, and the attachment portion rear 512*a* and the wall portion rear 903 are integrally molded as the spring holder rear 512 is exemplified, but it is not limited thereto. The wall portion front 902, the wall portion rear 903, the attachment portion front 511*a*, and the attachment portion rear 512*a* may be separately provided.

In addition, the substrate 502 has a rectangular shape, the length in the longitudinal direction is 340 mm, and the length in the lateral direction orthogonal to the longitudinal direction is 8.5 mm. In manufacturing the substrate 502, when the length in the longitudinal direction is manufactured with accuracy equivalent to the length in the lateral direction, for example, with a tolerance of ±0.5 mm, the cost increases. Therefore, in order to relatively reduce the manufacturing cost, the length of the substrate 502 in the longitudinal direction is allowed to vary with a tolerance of about ±1 mm. Therefore, the substrate 502 held by the holding member 505 and the spring holder front 511 and the spring holder rear 512 adhesively fixed to the holding member 505 need to be disposed at intervals in the rotational axis direction (longitudinal direction). The interval is wider than a gap between the U-shaped wall surface (extending portions 804R and 804L) of the holding member 505 in the lateral direction and the substrate 502 due to a difference in tolerance, and is about 2 mm. Here, when the tolerance at the time of manufacturing the substrate 502 can be reduced, the interval between the spring holder front 511 and the spring holder rear 512 and the end portions of the substrate 502 in the longitudinal direction can be made smaller than 2 mm. In the present example, the interval between the wall portion front 902 of the spring holder front 511 and the end portion of the substrate in the longitudinal direction and the interval between the wall portion rear 903 of the spring holder rear 512 and the end portion of the substrate 502 in the longitudinal direction are 2 mm or less.

Next, the configuration of the optical print head 105 will be described in more detail. The opening 701, which is a lens attachment portion, formed in the base portion 802 of the holding member 505 is an opening slightly larger than the lens array 506. The lens array 506 is inserted into the opening 701 of the holding member 505, adjusted in position, and fixed to the holding member 505 with an adhesive. In addition, the substrate 502 is formed to be slightly smaller than the interval between the extending portion 804R and the extending portion 804L of the holding member 505, and the position of the substrate 502 is adjusted so that the optical axis of the LEDs 503 is aligned with the center of the lens array 506. Thereafter, the substrate 502 is fixed to the holding member 505 with an adhesive between the extending portions 804R and 804L on both sides in the lateral direction of the holding member 505. This adhesive is, for example, an ultraviolet curable adhesive, applied to an adhesion site in a liquid or gel state, and then cured by being irradiated with ultraviolet rays.

Here, the lens array 506 and the substrate 502 are fixed to the holding member 505 by multi-point adhesion in a relatively short time, and gaps remain between the lens array 506 and the holding member 505 and between the substrate 502 and the holding member 505 even after adhesion by an adhesive. In addition, the interval between the end portion of the substrate 502 in the longitudinal direction and the spring holder front 511 and the spring holder rear 512 is an interval of equal to or less than 2 mm as described above. Thus, foreign matter such as toner can enter the space around the holding member 505, the LEDs 503 of the substrate 502, and the lens array 506, and there is a possibility that a problem such as a reduction in light quantity occurs.

Therefore, in the present example, as illustrated in FIG. 8, a sealing material 513 is applied so as to be in contact with both the lens array 506 and the holding member 505, and a gap between the lens array 506 inserted into and adhered to the opening 701 of the holding member 505 and the holding member 505 is sealed. In addition, a sealing material 514 is applied so as to be in contact with both the substrate 502 and the extending portions 804R and 804L, and gaps between the substrate 502 inserted and adhered between the extending portion 804R and the extending portion 804L of the holding member 505 and the extending portions 804R and 804L are sealed.

Further, as illustrated in FIGS. 9 and 10, the sealing material 514 is applied so as to be in contact with both the substrate 502 and the spring holder front 511 and the spring holder rear 512. Here, the wall portion front 902 is provided on the side of the spring holder front 511 facing the substrate 502, and the wall portion rear 903 is provided on the side of the spring holder rear 512 facing the substrate 502. The wall portion front 902 is provided between the end portion of the substrate 502 and the attachment portion front 511*a* of the spring holder front 511 in the rotational axis direction of the photoreceptor drum 103. The wall portion rear 903 is provided between the end portion of the substrate 502 and the attachment portion rear 512*a* of the spring holder rear 512 in the rotational axis direction of the photoreceptor drum 103. The wall portion front 902 and the wall portion rear 903 have an interval of 2 mm or less described above with respect to the end portion of the substrate 502 in the rotational axis direction. The sealing material 514 is applied so as to be in contact with both the wall portion front 902 and the substrate 502 and so as to be in contact with both the wall portion rear 903 and the substrate 502. Therefore, the sealing material 514 seals a gap between the end portion of the substrate 502 and the wall portion front 902 and a gap between the end portion of the substrate 502 and the wall portion rear 903.

In addition, the wall portion front 902 and the wall portion rear 903 have a shape along the U-shaped inner surface formed by the base portion 802, the first extending portion 804R, and the second extending portion 804L of the holding member 505.

In addition, the wall portion front 902 and the wall portion rear 903 are provided to protrude in a direction away from the photoreceptor drum 103 from the substrate 502 held by the holding member 505 in the moving direction (up-down direction) of the holding member 505. That is, in the optical print head of a lower surface exposure system, the wall portion front 902 and the wall portion rear 903 extend in the upward direction from the position of the substrate 502. Therefore, when the sealing material 514 is applied so as to be in contact with both the substrate 502 and the wall portion front 902 and the wall portion rear 903, the sealing material 514 does not climb over the wall portion front 902 or the wall portion rear 903.

The sealing materials 513 and 514 solidify with the lapse of time to seal the gap between the lens array 506 and the holding member 505, the gap between the substrate 502 and the holding member 505, and the gaps between the substrate 502 and (the wall portions of) the spring holders. As a result, the optical print head 105 can substantially seal the space around the LEDs 503 of the substrate 502 and the lens array 506 and can reduce the entry of foreign matter. In particular, the end portion of the substrate 502 is sealed by the wall portion and the sealing material in the rotational axis direction, and the entry of foreign matter can be further reduced. In addition, since the wall portion is provided and the gap with the wall portion is sealed with the sealing material 514, the inflow of the sealing material 514 into the LEDs 503 mounted on the substrate 502 can be suppressed. In addition, it is possible to suppress the inflow of the sealing material 514 into the lens array 506 held by the holding member 505. In addition, the use amount of the sealing material 514 can be suppressed to achieve cost reduction.

Note that, in the present example, silicon having appropriate flexibility is used as the sealing material, and is, for example, SE 9189 L which is a room-temperature curing type one-pack type RTV rubber manufactured by Dow Toray Co., Ltd. Due to the nature of silicon, it is configured to be relatively soft, and when filled, it can be flexibly deformed to substantially seal the gap. In addition, it has rigidity and strength on the order of a gel state while having flexibility, and the viscosity of the SE 9189 L is 22 Pa·s, and it is possible to favorably maintain the shape when applied without flowing down like a liquid.

In addition, as a method of applying the sealing material, it is favorable to precisely apply a liquid agent using a dispenser. In addition, SNA-12G manufactured by Musashi Engineering, Inc. or the like is used as a nozzle/needle as a discharge port of the sealing material. An inner diameter of the discharge port is larger than the interval between the substrate 502 and the spring holder front 511 and the spring holder rear 512. Specifically, the inner diameter of the discharge port (SNA-12G) is 2.27 mm, and about 2 mm, which is the interval between the substrate 502, the spring holder front 511 and the spring holder rear 512, can be applied at a time.

Example 2

Figure 11:
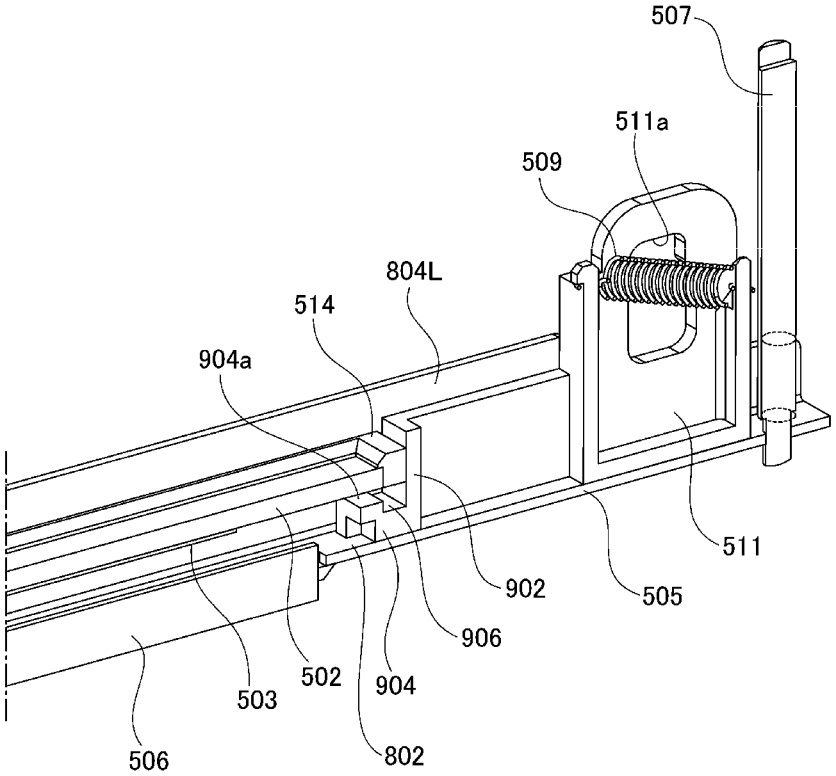
FIG. 11 is a cross-sectional perspective view of an optical print head.
Figure 12:
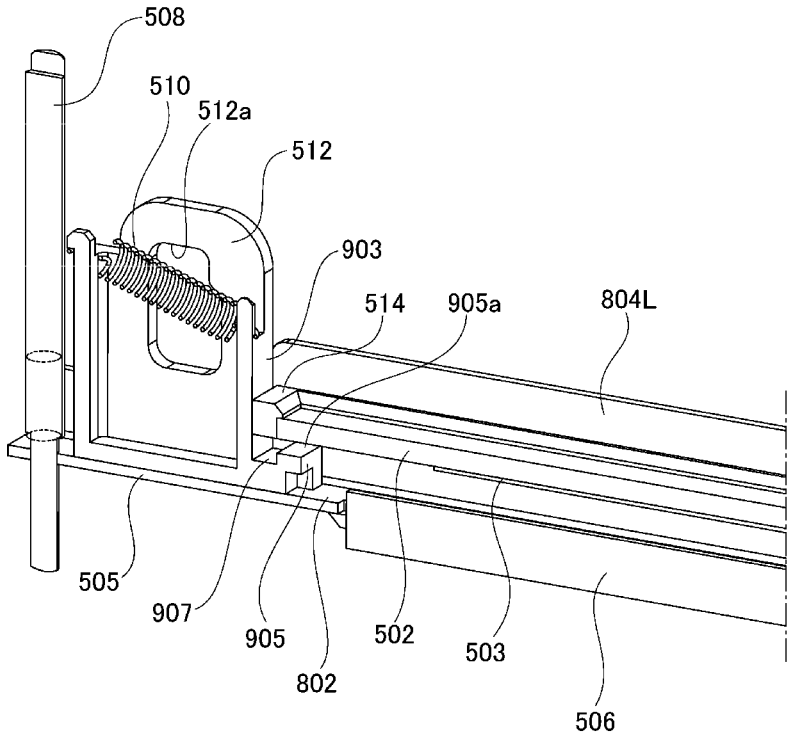
FIG. 12 is a cross-sectional perspective view of an optical print head.

An optical print head according to Example 2 will be described with reference to FIGS. 11 and 12. FIG. 11 is a cross-sectional perspective view of the optical print head according to the present example when cut at the spring holder front 511 (a portion indicated by the arrow B-B in FIG. 7) as in FIG. 9. In addition, as in FIG. 10, FIG. 12 is a cross-sectional perspective view when cut at the spring holder rear 512 (a portion indicated by the arrow C-C in FIG. 7).

The optical print head according to the present example is different in that a wall portion has a receiving portion and a first groove portion is provided on the receiving portion. Other configurations are similar to those of the above-described example, and thus, description thereof is omitted here.

The wall portion front 902 has a receiving portion front 904 extending from the wall portion front 902 toward the lens side along the inner surface of the base portion 802 of the holding member 505 facing the mounting surface of the substrate 502 on which the LEDs are mounted. The receiving portion front 904 is located between the wall portion front 902 and the lens array 506 in the longitudinal direction of the substrate 502.

The wall portion rear 903 has a receiving portion rear 905 extending from the wall portion rear 903 toward the lens side along the inner surface of the base portion 802 of the holding member 505 facing the mounting surface of the substrate 502 on which the LEDs are mounted. The receiving portion rear 905 is located between the wall portion rear 903 and the lens array 506 in the longitudinal direction of the substrate 502.

In the receiving portion front 904, a first groove portion front 906 is provided on a facing surface 904*a* facing the mounting surface of the substrate 502 along a direction orthogonal to the longitudinal direction. The first groove portion front 906 forms a step between the facing surface 904*a* and the wall portion front 902. In the receiving portion rear 905, a first groove portion rear 907 is provided on a facing surface 905*a* facing the mounting surface of the substrate 502 along a direction orthogonal to the longitudinal direction. The first groove portion rear 907 forms a step between the facing surface 905*a* and the wall portion rear 903.

With the above configuration, even when the sealing material 514 applied so as to be in contact with both the substrate 502 and the wall portion front 902 flows out in the downward direction through the gap between the substrate 502 and the wall portion front 902, it is possible to receive the sealing material in the receiving portion front 904 and further to retain the sealing material at the first groove portion front 906. Thus, it is possible to suppress inflow of the sealing material 514 to the LEDs 503 mounted on the substrate 502. In addition, it is possible to suppress the inflow of the sealing material 514 into the lens array 506 held by the holding member 505. Even when the sealing material 514 applied so as to be in contact with both the substrate 502 and the wall portion rear 903 flows out in the downward direction through the gap between the substrate 502 and the wall portion rear 903, it can be similarly suppressed.

In addition, the receiving portion front 904 and the receiving portion rear 905 are provided outside the end portions of the lens array 506 held by the holding member 505 in the rotational axis direction, and are provided outside the region of the substrate 502 where the LEDs are mounted. Therefore, the receiving portion front 904 and the receiving portion rear 905 do not block the light emitted from the LEDs toward the lens array 506.

Example 3

Figure 13:
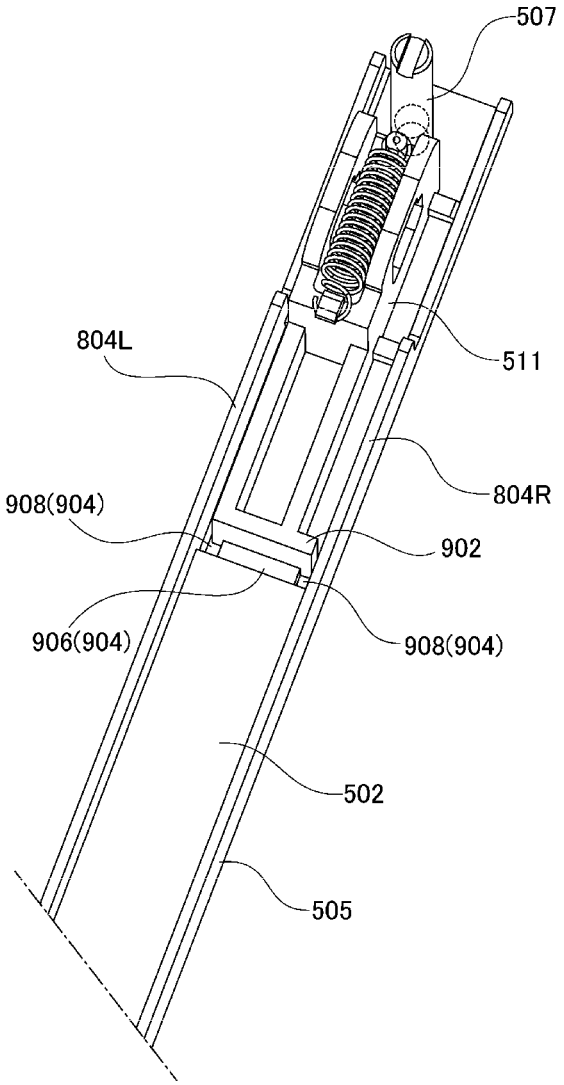
FIG. 13 is a perspective view illustrating a part of an optical print head.
Figure 14:
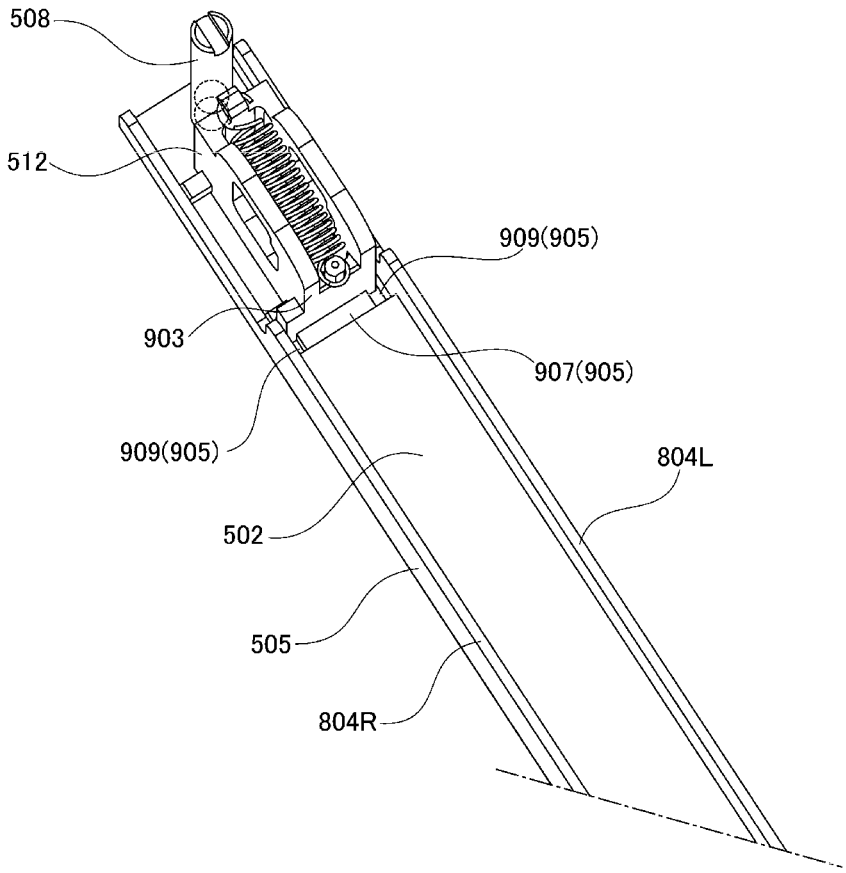
FIG. 14 is a perspective view illustrating a part of an optical print head.

An optical print head according to Example 3 will be described with reference to FIGS. 13 and 14. FIG. 13 is a perspective view of the optical print head according to the present example before application of the sealing material in the vicinity of the spring holder front 511. In addition, it is a perspective view of the vicinity of the spring holder rear 512 before application of the sealing material.

The optical print head according to the present example is different in that the receiving portion of the wall portion of the spring holder is further provided with a cutout portion. Other configurations are similar to those of the above-described example, and thus, description thereof is omitted here.

The receiving portion front 904 of the spring holder front 511 is provided with a cutout portion front 908 along a direction orthogonal to the longitudinal direction on a first surface (not illustrated) facing the first extending portion 804R of the holding member 505. The cutout portion front 908 forms a step between the first surface and the wall portion front 902. The receiving portion front 904 is provided with a cutout portion front 908 along a direction orthogonal to the longitudinal direction on a second surface (not illustrated) facing the second extending portion 804L of the holding member 505. The cutout portion front 908 forms a step between the second surface and the wall portion front 902. The cutout portion front 908 facing the first extending portion 804R and the cutout portion front 908 facing the second extending portion 804L are connected to the first groove portion front 906.

The receiving portion rear 905 of the spring holder rear 512 is provided with a cutout portion rear 909 along a direction orthogonal to the longitudinal direction on a first surface (not illustrated) facing the first extending portion 804R of the holding member 505. The cutout portion rear 909 forms a step between the first surface and the wall portion rear 903. The receiving portion rear 905 is provided with a cutout portion rear 909 along a direction orthogonal to the longitudinal direction on a second surface (not illustrated) facing the second extending portion 804L of the holding member 505. The cutout portion rear 909 forms a step between the second surface and the wall portion rear 903. The cutout portion rear 909 facing the first extending portion 804R and the cutout portion rear 909 facing the second extending portion 804L are connected to the first groove portion rear 907.

With the above configuration, the cutout portion front 908 and the cutout portion rear 909 are provided near corner portions of the substrate 502 facing the wall portion of each spring holder. Therefore, the corner portions of the substrate 502 can be easily filled with the sealing material 514 along each wall portion. In addition, even when the sealing material 514 flows out in the downward direction through the gap between the end portion of the substrate and the wall portion, it is possible to further prevent the sealing material 514 from flowing to the lens array 506.

Note that the configuration in which the cutout portion front 908 and the cutout portion rear 909 are connected to the first groove portion front 906 and the first groove portion rear 907 described in Example 2 described above has been exemplified, but the above-described effect can be obtained even when the receiving portion does not have the first groove portion.

Example 4

Figure 15:
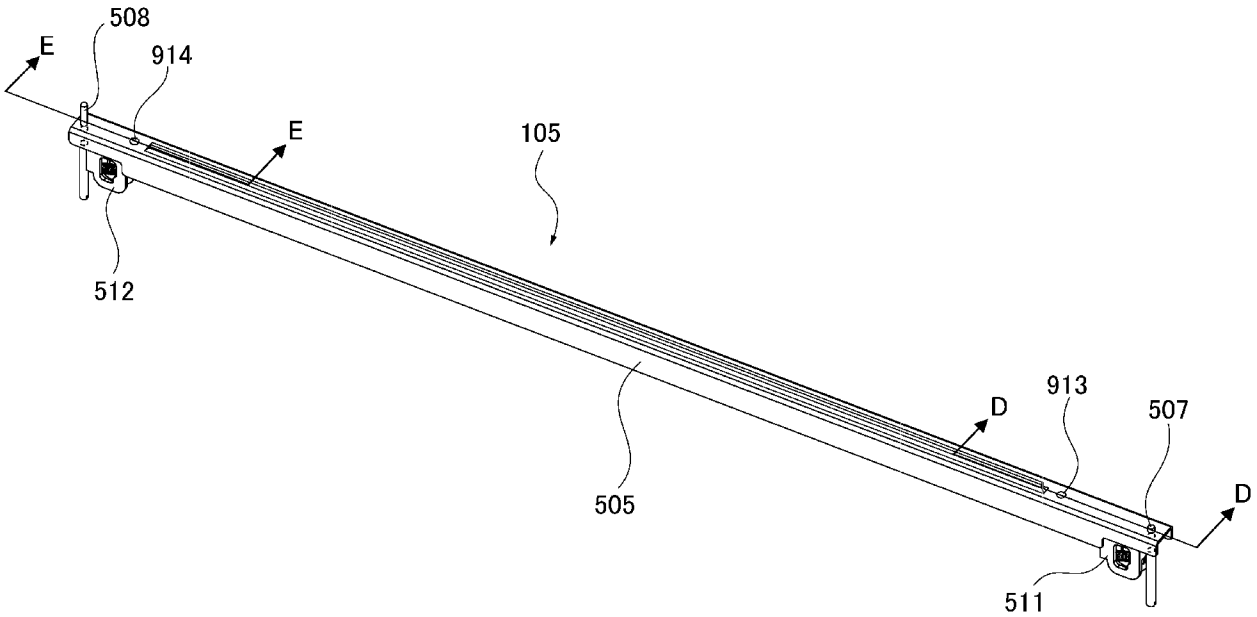
FIG. 15 is a perspective view of an optical print head.
Figure 16:
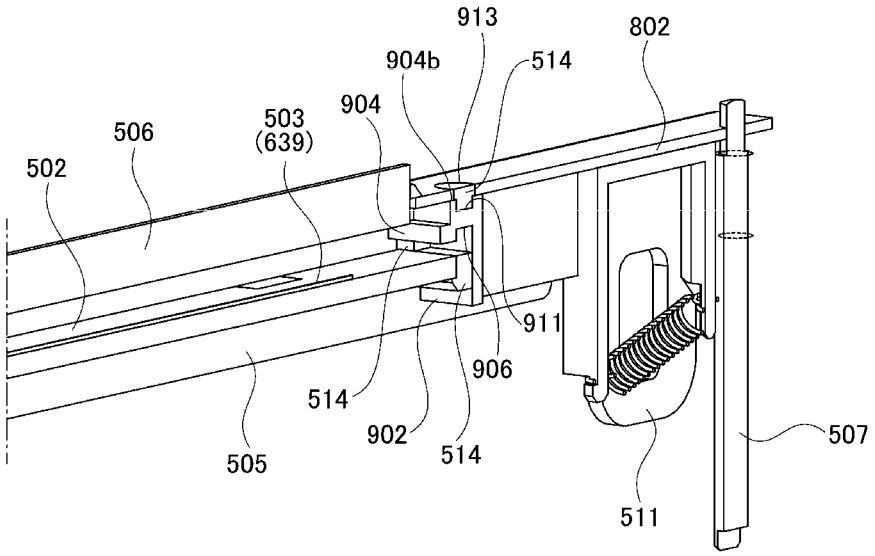
FIG. 16 is a cross-sectional perspective view of an optical print head.
Figure 17:
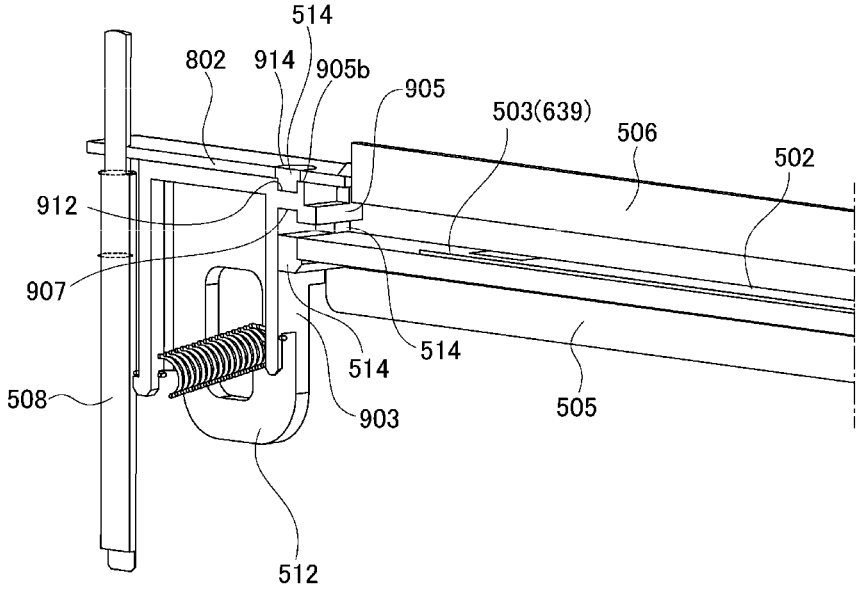
FIG. 17 is a cross-sectional perspective view of an optical print head.

An optical print head according to Example 4 will be described with reference to FIGS. 15, 16, and 17. FIG. 15 is a perspective view of the optical print head. FIG. 16 is a cross-sectional perspective view of the optical print head cut at the spring holder front 511 (a portion indicated by an arrow D-D in FIG. 15). In addition, FIG. 17 is a cross-sectional perspective view of the optical print head cut at the spring holder rear 512 (a portion indicated by an arrow E-E in FIG. 15).

The optical print head according to the present example is different in that the receiving portion of the wall portion of the spring holder is further provided with a second groove portion. Further, a through-hole connected to the second groove portion is provided in the base portion of the holding member. Other configurations are similar to those of the above-described example, and thus, description thereof is omitted here.

In the optical print head 105, the spring holder front 511 and the spring holder rear 512 are adhesively fixed to the holding member 505. However, a slight gap may be formed between the spring holder front 511, the spring holder rear 512, and the holding member 505. Therefore, the optical print head 105 according to the present example is configured as described below in order to facilitate filling of the sides of the spring holder front 511 and the spring holder rear 512 facing the base portion 802 of the holding member 505 with the sealing material 514.

In the receiving portion front 904 of the spring holder front 511, a second groove portion front 911 is provided on a facing surface 904*b* facing the base portion 802 of the holding member 505 along a direction orthogonal to the longitudinal direction. The second groove portion front 911 forms a step between the facing surface 904*b* and the wall portion front 902. The second groove portion front 911 is connected to the cutout portion front 908 facing the first extending portion 804R and the cutout portion front 908 facing the second extending portion 804L illustrated in FIG. 13.

The receiving portion rear 905 of the spring holder rear 512 is provided with a second groove portion rear 912 along a direction orthogonal to the longitudinal direction on a facing surface 905*b* facing the base portion 802 of the holding member 505. The second groove portion rear 912 forms a step between the facing surface 905*b* and the wall portion rear 903. The second groove portion rear 912 is connected to the cutout portion rear 909 facing the first extending portion 804R and the cutout portion rear 909 facing the second extending portion 804L illustrated in FIG. 14.

In addition, a through-hole front 913 connected to the second groove portion front 911 is provided in the base portion 802 of the holding member 505. Similarly, a through-hole rear 914 connected to the second groove portion rear 912 is provided in the base portion 802 of the holding member 505.

With the above configuration, the sealing material 514 is loaded from the through-hole front 913 and the through-hole rear 914 of the base portion 802 of the holding member 505 to the second groove portion front 911 and the second groove portion rear 912 of the spring holder front 511 and the spring holder rear 512. Therefore, the spring holder front 511 and the spring holder rear 512 can be sealed even when there is a slight gap with respect to the holding member 505.

Here, the second groove portion front 911 and the second groove portion rear 912 are connected to the cutout portion front 908 and the cutout portion rear 909, respectively. Therefore, the sealing material 514 may pass through the cutout portion front 908 and the cutout portion rear 909 to fill the second groove portion front 911 and the second groove portion rear 912 without forming through-holes in the base portion 802 of the holding member 505.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Patent Application No. 2021-099302, filed Jun. 15, 2021, which is hereby incorporated by reference herein in its entirety.

What is claimed is:

1. An optical print head comprising:

a substrate on which a plurality of light emitting elements is mounted;

a lens configured to condense light emitted from the plurality of light emitting elements on a photoreceptor;

a holder configured to hold the substrate and the lens, the holder being formed in a U shape with a base portion including an opening into which the lens is inserted, a first extending portion extending in a direction away from the photoreceptor from one side in a lateral direction orthogonal to a longitudinal direction of the substrate, and a second extending portion extending in the direction away from the photoreceptor from another side in the lateral direction, the lens inserted into the opening being held by the base portion, the substrate being held by the first extending portion and the second extending portion;

a wall portion provided outside an end portion of the substrate in the longitudinal direction and facing a surface of the substrate intersecting in the longitudinal direction, the wall portion having a shape along a U-shaped inner surface formed by the base portion, the first extending portion and the second extending portion; and a sealing material configured to seal a gap between the surface of the substrate and the wall portion in the longitudinal direction.

2. The optical print head according to claim 1, wherein an interval between the end portion of the substrate and the wall portion in the longitudinal direction is 2 mm or less.

3. The optical print head according to claim 1, wherein the wall portion includes a receiving portion extending from the wall portion toward a lens side along an inner surface of the base portion of the holder facing a mounting surface of the substrate on which the plurality of light emitting elements are mounted, and the receiving portion is located between the wall portion and the lens in the longitudinal direction.

4. The optical print head according to claim 3, wherein the receiving portion is provided with a groove portion in a direction orthogonal to the longitudinal direction on a facing surface facing the mounting surface of the substrate.

5. The optical print head according to claim 3, wherein the receiving portion is provided with a cutout portion along a direction orthogonal to the longitudinal direction on each of a first surface facing the first extending portion and a second surface facing the second extending portion of the holder.

6. The optical print head according to claim 3, wherein the receiving portion is provided with a groove portion along a direction orthogonal to the longitudinal direction on a surface facing the base portion of the holder.

7. The optical print head according to claim 6, wherein a through-hole connected to the groove portion is provided in the base portion of the holder.

8. The optical print head according to claim 1, wherein the holder is made of metal.

9. An image forming apparatus with a photoreceptor and the optical print head according to claim 1 configured to expose the photoreceptor.

* * * * *